US010968729B2

(12) United States Patent
Sylvester

(10) Patent No.: US 10,968,729 B2
(45) Date of Patent: Apr. 6, 2021

(54) DOWNHOLE HEATER

(71) Applicant: Glenn Clay Sylvester, League City, TX (US)

(72) Inventor: Glenn Clay Sylvester, League City, TX (US)

( * ) Notice: Subject to any disclaimer, the term of this patent is extended or adjusted under 35 U.S.C. 154(b) by 213 days.

(21) Appl. No.: 15/616,638

(22) Filed: Jun. 7, 2017

(65) Prior Publication Data

US 2017/0356280 A1 Dec. 14, 2017

Related U.S. Application Data

(60) Provisional application No. 62/347,951, filed on Jun. 9, 2016.

(51) Int. Cl.

| | |
|---|---|
| ***E21B 43/24*** | (2006.01) |
| ***E21B 17/00*** | (2006.01) |
| ***E21B 33/12*** | (2006.01) |
| ***E21B 34/06*** | (2006.01) |
| ***E21B 43/08*** | (2006.01) |
| ***E21B 43/12*** | (2006.01) |
| ***E21B 43/38*** | (2006.01) |

(52) U.S. Cl.

CPC ..... *E21B 43/2401* (2013.01); *E21B 17/003* (2013.01); *E21B 33/12* (2013.01); *E21B 34/06* (2013.01); *E21B 43/08* (2013.01); *E21B 43/121* (2013.01); *E21B 43/38* (2013.01)

(58) Field of Classification Search

CPC ..... E21B 35/00–04; E21B 43/38

See application file for complete search history.

(56) References Cited

U.S. PATENT DOCUMENTS 1,504,208 A * 8/1924 Brine ..... E21B 36/04 392/305
1,578,720 A * 3/1926 Derby ..... F04B 47/00 166/105.5
1,674,815 A * 6/1928 Barnhart ..... E21B 43/121 166/105.5
1,690,994 A * 11/1928 Powell ..... H05B 3/00 174/77 R
1,701,884 A * 2/1929 Hogle ..... E21B 36/04 392/301
2,134,610 A * 10/1938 Hogg ..... E21B 36/04 166/60
2,244,256 A * 6/1941 Looman ..... E21B 36/04 166/60
2,332,708 A * 10/1943 Freeman ..... E21B 36/04 392/303
2,345,710 A * 4/1944 Lybyer ..... F04B 53/00 166/105.1
2,362,680 A * 11/1944 Troupe ..... E21B 36/04 166/60

(Continued)

*Primary Examiner* — Steven A MacDonald

(74) *Attorney, Agent, or Firm* — Wilson Daniel Swayze, Jr.

(57) ABSTRACT

A downhole heating apparatus includes a gas separator, a downhole heater, a thermal barrier and lower and upper perforated tubing joints being vents. The thermal barrier retards fluid and heat from flowing between a lower annulus of a wellbore and an upper annulus of a wellbore. The thermal barrier is formed from one or more thermal barrier subcomponents. The downhole heater is an electrical heater. The thermal barrier and lower and upper perforated tubing joints includes one or more vents.

71 Claims, 9 Drawing Sheets

(56) References Cited

U.S. PATENT DOCUMENTS 2,636,445 A * 4/1953 Tutton ..... E21B 36/006 417/54
2,771,140 A * 11/1956 Barclay ..... E21B 36/02 166/60
3,045,755 A * 7/1962 Page ..... E21B 33/1294 166/129
3,131,763 A * 5/1964 Kunetka ..... E21B 36/04 166/60
3,306,313 A * 2/1967 Roach ..... E21B 43/123 137/102
4,127,169 A * 11/1978 Tubin ..... E21B 43/2401 166/250.01
4,185,691 A * 1/1980 Tubin ..... E21B 36/04 166/302
4,676,308 A * 6/1987 Chow ..... E21B 43/38 166/105.5
4,834,174 A * 5/1989 Vandevier ..... E21B 36/04 166/188
6,322,616 B1 * 11/2001 Kennedy ..... B01D 19/0057 166/105.5
6,412,563 B1 * 7/2002 William St. Clair ..... E21B 43/128 166/105.3
7,104,321 B2 * 9/2006 Carruth ..... B01D 19/0042 166/105.5
2003/0075330 A1 * 4/2003 Hill ..... E21B 36/04 166/302
2004/0216881 A1 * 11/2004 Hill ..... E21B 36/04 166/302
2008/0047711 A1 * 2/2008 Hill ..... E21B 36/04 166/302
2009/0166032 A1 * 7/2009 Carr, Sr. ..... E21B 36/005 166/250.01
2011/0017510 A1 * 1/2011 Emerson ..... E21B 17/028 174/84 C
2013/0068455 A1 * 3/2013 Brown ..... E21B 43/121 166/265
2014/0076545 A1 * 3/2014 Sutton ..... E21B 36/006 166/250.01
2016/0333681 A1 * 11/2016 Mazzanti ..... E21B 43/38
2017/0292361 A1 * 10/2017 Beauquin ..... E21B 43/121

* cited by examiner

DOWNHOLE HEATER

CROSS-REFERENCE TO RELATED APPLICATIONS

This application is a nonprovisional application that claims priority from U.S. provisional application No. 62/347,951, filed Jun. 9, 2016.

TECHNICAL FIELD/FIELD OF THE DISCLOSURE

The present disclosure relates generally to downhole tools, and specifically to downhole heating tools.

BACKGROUND OF THE DISCLOSURE

During production of a hydrocarbon bearing formation, the content of the formation may lead to low rates of production. For example, where heavy oils such as those including asphaltene and/or paraffin are encountered, high density and viscosity may slow or prevent the hydrocarbons from migrating out of the wellbore. Because the viscosity of these oils may reduce as temperature increases, heating the wellbore and formation may increase production rates in the formation. However, as fluid enters the wellbore, asphaltene may fall out of solution and clog the wellbore.

SUMMARY

The present disclosure provides for a downhole heating apparatus. The downhole heating apparatus may include a mandrel. The downhole heating apparatus may include a thermal barrier positioned on an exterior surface of the mandrel. The thermal barrier may include one or more thermal barrier subcomponents. The downhole heating apparatus may include a downhole heater mechanically coupled to the mandrel. The downhole heater may be positioned below the thermal barrier. The downhole heater may include an electric heating element.

The present disclosure also provides for a downhole apparatus. The downhole apparatus may include a mandrel. The downhole apparatus may include a thermal barrier positioned on an exterior surface of the mandrel. The thermal barrier may include one or more thermal barrier subcomponents. The downhole apparatus may include a gas separator mechanically coupled to the mandrel.

The present disclosure also provides for a system. The system may include a wellbore formed in a downhole formation. The wellbore may include a casing. The casing may include one or more perforations. The system may include a downhole heating apparatus positioned within the wellbore. The downhole apparatus may be mechanically coupled to a tubing string. The downhole heating apparatus may include a mandrel. The downhole heating apparatus may include a thermal barrier positioned on an exterior surface of the mandrel. The thermal barrier may include one or more thermal barrier subcomponents. The thermal barrier may extend from the exterior surface of the mandrel. The thermal barrier may be positioned above the perforations in the casing. The thermal barrier may define an upper annulus and a lower annulus, the upper annulus defined as the interior of the casing above the thermal barrier and the lower annulus defined as the interior of the casing below the thermal barrier. The downhole heating apparatus may include a gas separator mechanically coupled to the mandrel.

BRIEF DESCRIPTION OF THE DRAWINGS

In the following detailed description and accompanying figures, various features are not drawn to scale. The dimensions of the various features may be increased or reduced for clarity of discussion.

DETAILED DESCRIPTION

Figure 1:
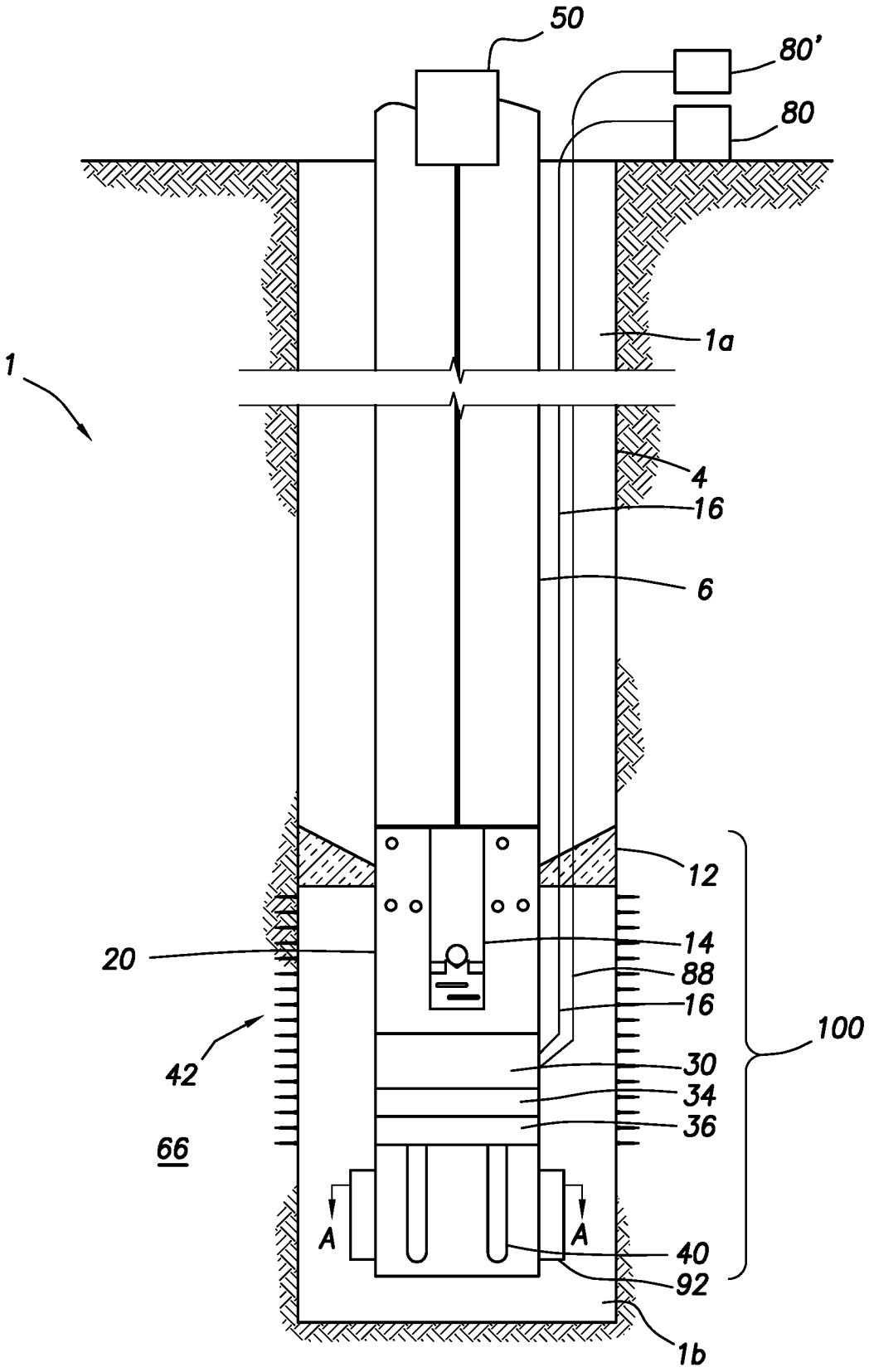
FIG. 1 depicts a downhole heating apparatus consistent with at least one embodiment of the present disclosure positioned in a wellbore.

The following disclosure provides many different embodiments, or examples, for implementing different features of various embodiments. Specific examples of components and arrangements are described below to simplify the present disclosure. These are examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. In disclosure, "below" denotes a positional relationship further from the surface in a wellbore when the described component or components are positioned in the wellbore, and "above" denotes a positional relationship closer to the surface in a wellbore when the described component or components are positioned in the wellbore.

FIG. 1 depicts downhole heating apparatus 100 positioned in wellbore 1. Wellbore 1, as used herein, may include vertical wells, horizontal wells, deviated wells, or wells of any configuration. Downhole heating apparatus 100 may be positioned in wellbore 1 within downhole formation 66. Downhole formation 66 may be formed of earthen materials including, for example and without limitation, sand, shale, limestone, or dolomite. Downhole formation 66 may include one or more fluids, such as, for example and without limitation, water, oil, and gas. In some embodiments, wellbore 1 may be an uncased or open wellbore. In some embodiments, wellbore 1 may include casing 4. Casing 4 may be a metal tube, and may include one or more casing perforations 42 which may fluidly couple the interior of casing 4 with downhole formation 66. In some embodiments, fluid lift device 50 may be positioned at least partially within tubing string 6. Fluid lift device 50 may provide artificial lift to fluids within wellbore 1. Fluid lift device 50 may be, for example and without limitation, one or more of a rod pump, submersible pump, jet pump, hollow sucker rod, fluid circulating pump, progressive cavity pump, or any other suitable fluid lifting device.

In some embodiments, downhole heating apparatus 100 may be mechanically coupled to tubing string 6. In some embodiments, tubing string 6 may be production tubing. In some embodiments, tubing string 6 may be any suitable tubular, including, for example and without limitation, coiled tubing, tubular segments, drill pipe, or casing segments.

In some embodiments, one or more electrical connections may extend through wellbore 1 to downhole heating apparatus 100. For example and without limitation, power cable 16 may extend from voltage controller 80 located at the surface to downhole heating apparatus 100. In some embodiments, voltage controller 80 may control the temperature of downhole heater 40. In some embodiments, voltage controller 80 may operate to maintain a constant temperature at one or more locations in wellbore 1. Power cable 16 may carry electrical power to one or more of fluid lift device 50 and downhole heating apparatus 100 as discussed further herein below. In some embodiments, thermocouple cable 88 may extend from thermocouple circuit 80' to downhole heating apparatus 100. Thermocouple cable 88 may, for example and without limitation, be used to determine a temperature within wellbore 1 or within one or more parts of downhole heating apparatus 100 as discussed further herein below. Although depicted in FIG. 1 as separate cables, power cable 16 and thermocouple cable 88 as well as any other electrical cables may be integrated into a single cable. Although depicted as extending through the annulus one or both of power cable 16 and thermocouple cable 88 may extend through tubing string 6. In some embodiments, thermocouple cable 89 may extend through the annulus of casing 4.

In some embodiments, downhole heating apparatus 100 may include mandrel 20. Mandrel 20 may be generally tubular in shape. In some embodiments, mandrel 20 may mechanically couple to tubing string 6. In some embodiments, mandrel 20 may be formed from a lower part of tubing string 6. Mandrel 20 may form an outer housing of downhole heating apparatus 100. In some embodiments, as used herein, mandrel 20 may include one or more components of downhole heating apparatus 100. In some embodiments, downhole heating apparatus 100 may include downhole heater 40 and gas separator 14. In some embodiments, downhole heating apparatus 100 may include heater terminal block 36, integral union 34, and pothead 30, each of which is discussed further herein below.

Figure 2:
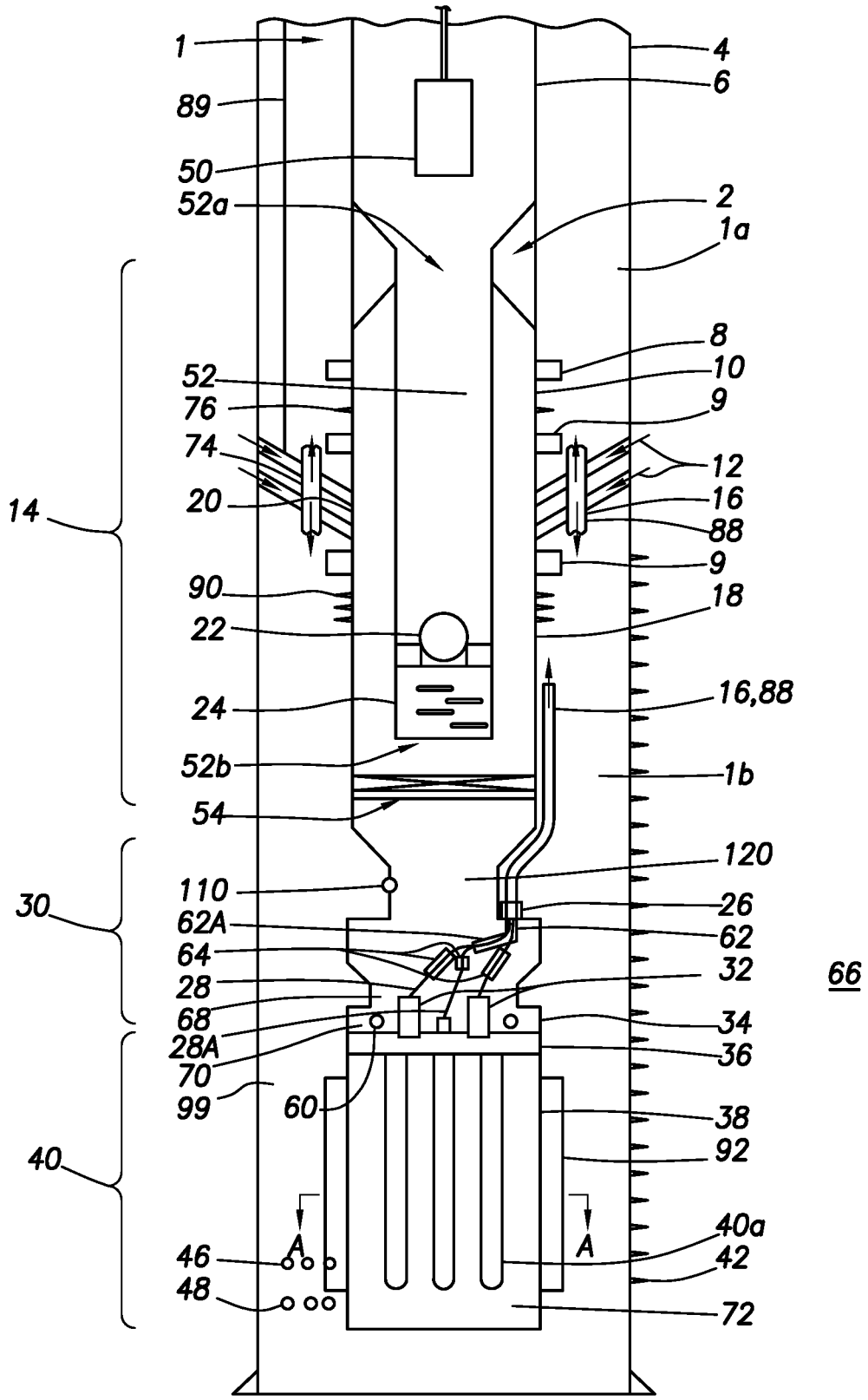
FIG. 2 depicts a cross section view of a downhole heating apparatus consistent with at least one embodiment of the present disclosure.

In some embodiments, downhole heating apparatus 100 may include thermal barrier 12. Thermal barrier 12 may be positioned on an exterior surface of mandrel 20. In some embodiments, thermal barrier 12 may be an extension from mandrel 20 to, for example and without limitation, reduce the cross sectional area between downhole heating apparatus 100 and casing 4. In some embodiments, as depicted in FIG. 2, thermal barrier 12 may be retained in place on mandrel 20 by one or more retaining rings 9. In some embodiments, thermal barrier 12 may be any suitable structure for retarding flow of one or both of fluid and heat between the annulus of casing 4 below thermal barrier 12, defining lower annulus 1*b*, and above thermal barrier 12, defining upper annulus 1*a*. For example and without limitation, fluid within lower annulus 1*b* may include liquid 46 and gas 48. Liquid 46 for the purpose of this disclosure may include, for example and without limitation, hydrocarbons including, for example and without limitation, oil, asphaltenes, paraffins, and any other hydrocarbon fraction, and any other liquids such as water. Heat within lower annulus 1*b* of casing 4 below thermal barrier 12 may, for example and without limitation, extend radially into downhole formation 66 surrounding downhole heating apparatus 100. In some embodiments, thermal barrier 12 may not form a fluid seal with casing 4. In some embodiments, heat within lower annulus 1*b* may rise within casing 4 to, for example and without limitation, heat components of fluid lifting device 50. In certain embodiments, heat is not fully sealed below thermal barrier 12. In some embodiments, thermal barrier 12 may include a pothead sized for retarding flow of one or both of fluid and heat between lower annulus 1*b* and upper annulus 1*a*.

Figure 7:
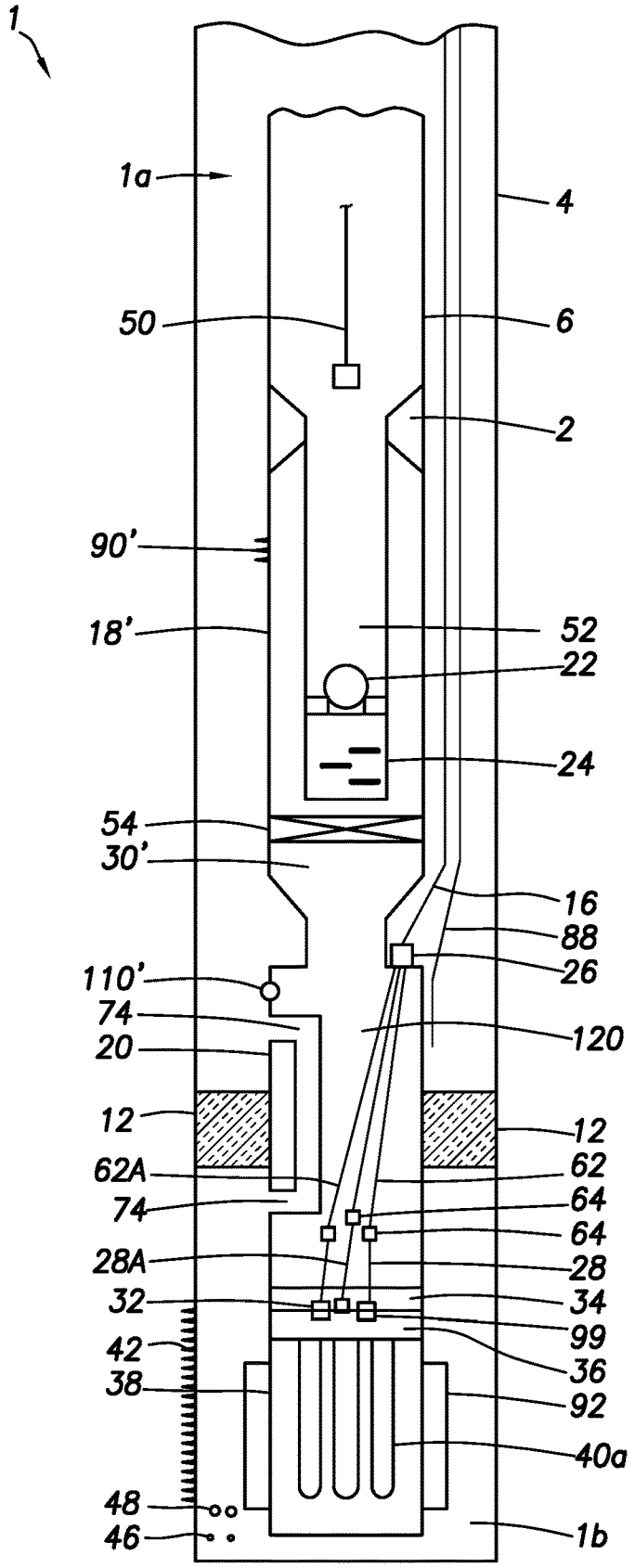
FIG. 7 depicts a cross section of a downhole heating apparatus consistent with at least one embodiment of the present disclosure.

In some embodiments, thermal barrier 12 may include one or more thermal barrier subcomponents. In some embodiments, thermal barrier 12 may be formed from a high temperature material resistant to liquid 46 and gas 48 within wellbore 1 including, but not limited to, chemicals. In some embodiments, thermal barrier 12 may be formed from an inflexible material such as a metal or fiberglass sleeve. In some embodiments, thermal barrier 12 may be formed from a tubing collar. In some embodiments, thermal barrier 12 may be formed from a mechanical packer or swellable packer. In some embodiments, thermal barrier 12 may be formed from a flexible material. For example and without limitation, thermal barrier 12 may be formed from one or more of rubber or polytetrafluoroethylene. In some embodiments, thermal barrier 12 may include one or more casing swab cups. In some such embodiments, the swab cups may be, for example and without limitation, one or more of V, GW, RTV, EL, M, BM, BV, BX, TA, TUF, UF, NUF, and HPR type swab cups. In some embodiments, thermal barrier 12 may be made up of one or more of, for example and without limitation, swab V-cups, packer elements, seating cups, sliding mandrel rubber, or other molded rubber elements. In some embodiments, thermal barrier 12 may be formed from a metal. In some embodiments, thermal barrier 12 may be formed from a rubber including, for example and without limitation, nitrile rubber, oil resistant nitrile rubber, or any other rubbers suitable for temperatures encountered within wellbore 1. In some embodiments, thermal barrier 12 may include one or more of a steel wire framework, or one or more metal sleeves formed from, for example and without limitation, steel or aluminum. In some embodiments, one or more cables including power cable 16 and thermocouple cable 88 may pass through channels formed in thermal barrier 12. In some embodiments, one or more cables including power cable 16 and thermocouple cable 88 may be molded integrally into thermal barrier 12. In some embodiments, as depicted in FIG. 7, power cable 16 and thermocouple cable 88 may enter pothead 30' at a position above thermal barrier 12.

In some embodiments, thermal barrier 12 may not fully thermally seal between mandrel 20 and casing 4. In some such embodiments, thermal barrier 12 may provide one or more thermal flow paths for a portion of the heat generated by downhole heater 40 to rise through thermal barrier 12 into the annulus of wellbore 1 above thermal barrier 12. In some embodiments, the thermal flow paths may be one or more vents 74 which provide fluid communication between upper annulus 1*a* and lower annulus 1*b* as discussed further herein below.

In some embodiments, as depicted in FIG. 2, downhole heating apparatus 100 may be placed in wellbore 1 such that thermal barrier 12 is positioned above casing perforations 42. In some embodiments, downhole heating apparatus 100 may be placed in wellbore 1 such that thermal barrier 12 is positioned below casing perforations 42, wherein casing perforations 42 are aligned with known gas bearing portions of downhole formation 66 and above casing perforations 42 aligned with liquid bearing portions of downhole formation 66.

In some embodiments, downhole heater 40 may be positioned below thermal barrier 12 of downhole heating apparatus 100. In some embodiments, downhole heater 40 may be positioned below casing perforations 42. In some embodiments, downhole heater 40 may include heater casing 38 and one or more electric heating elements 40*a*. Downhole heater 40 may be formed in varying lengths determined by one or more aspects of downhole formation 66. In some embodiments, for example and without limitation, downhole heater 40 may be formed in a length corresponding with the length of casing 4 including casing perforations 42 or the length of a known oil bearing portion of downhole formation 66. Electric heating elements 40*a* may be any electric heating element known in the art, including, for example and without limitation, a resistance heating element including a coiled element. In some embodiments, electric heating elements 40*a* may be formed as an induction heater, cartridge heater, mineral insulated cable, or dry well heater.

In some embodiments, electric heating elements 40*a* may be positioned within heater casing 38. In some embodiments, heater casing 38 may be formed from a material such as steel. In some embodiments, heater casing 38 may, for example and without limitation, protect electric heating elements 40*a* as downhole heating apparatus 100 is inserted into wellbore 1. In some embodiments, heater casing 38 may be formed from a material having high heat transfer properties including, for example and without limitation, aluminum. In some embodiments, heater casing 38 may include one or more holes, slots, or perforations to allow fluid within lower annulus 1*b* to enter heater casing 38.

In some embodiments, electric heating elements 40*a* may be encased within heater casing 38. Heater casing 38 may form a fluid enclosure about electric heating elements 40*a*. Heater casing 38 may be heated by electric heating elements 40*a* and transfer the heat to fluid in lower annulus 1*b*. In some embodiments, heat transfer fluid 72 may be positioned within heater casing 38 to, for example and without limitation, protect electric heating elements 40*a* from, for example and without limitation, overheating or corrosion, and facilitate heat transfer between electric heating elements 40*a* and heater casing 38. In some embodiments, heat transfer fluid 72 may be a non-corrosive fluid with high temperature tolerance and low thermal expansion. For example and without limitation, in some embodiments, heat transfer fluid 72 may be a glycol such as, for example and without limitation, triethylene glycol. In some embodiments, heat transfer fluid 72 may be a hydrocarbon such as motor oil. In some embodiments, heater casing 38 may be at least partially filled with heat transfer fluid 72 such that allowance is made for any expansion of heat transfer fluid 72.

In some embodiments, heater casing 38 may be formed to have a length longer than the length of electric heating elements 40*a*. In such an embodiment, heat transfer fluid 72 may heat heater casing 38 by, for example and without limitation, convection of heat transfer fluid 72.

In some embodiments, heat from electric heating elements 40*a* may pass into heater casing 38. Heated heater casing 38 may contact and transfer heat to fluids and other materials within lower annulus 1*b*. In some embodiments, for example and without limitation, components of the fluid including asphaltenes, paraffins, and other viscous components of liquid 46 within lower annulus 1*b* may be heated or melted. In some embodiments, heat from electric heating elements 40*a* may heat formation fluids in casing perforations 42 and downhole formation 66. The viscosity of liquid 46 within lower annulus 1*b* may, without being bound to theory, lower in viscosity and may be more easily produced by fluid lift device 50.

Figure 6:
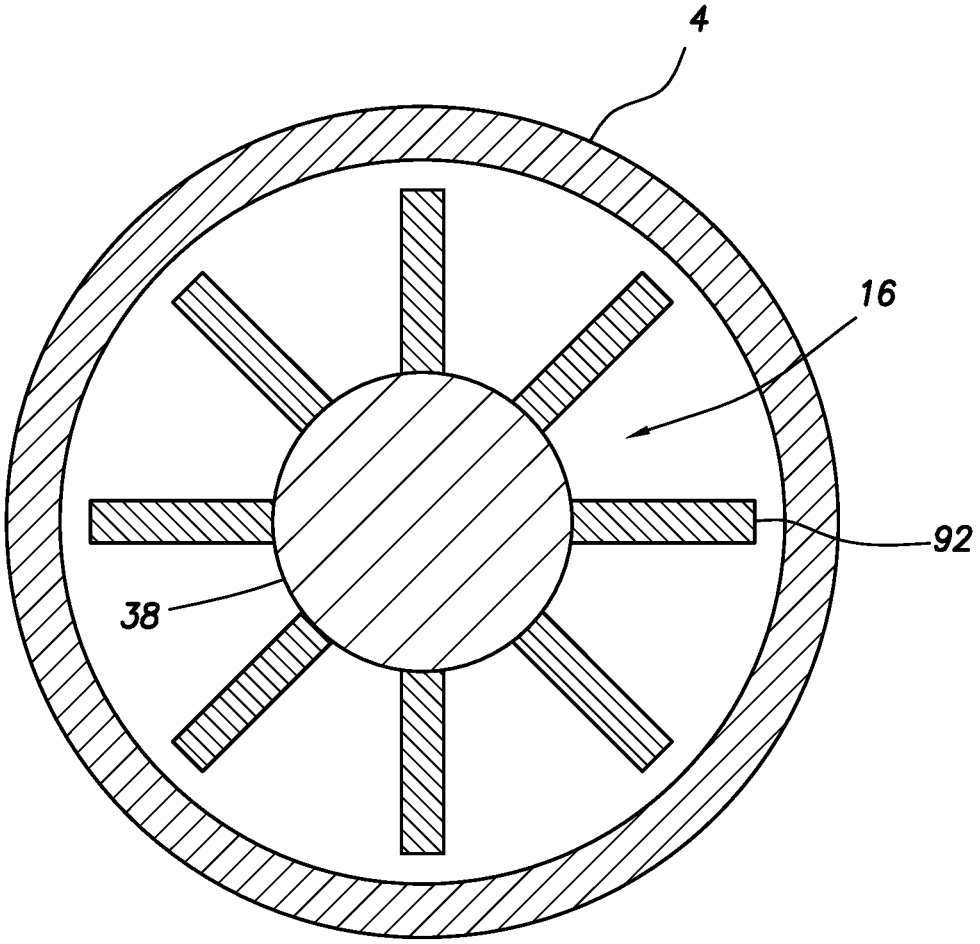
FIG. 6 depicts a cross section of a downhole heater of a downhole heating apparatus consistent with at least one embodiment of the present disclosure.

In some embodiments, heater casing 38 may include one or more fins 92. Fins 92, as depicted in FIG. 6, may extend radially outward into lower annulus 1*b*. In some embodiments, fins 92 may, for example and without limitation, increase heat transfer between heater casing 38 and fluid within lower annulus 1*b*. In some embodiments, fins 92 may be vertical, horizontal, spiral, helical, or any other suitable configuration.

In some embodiments, although depicted as a single unit, downhole heater 40 may include multiple segments mechanically linked together, and may be electrically interconnected. In some embodiments, downhole heater 40 may include one or more lengths of non-heated elements between heated elements to, for example and without limitation, separate the heated areas.

Figure 5:
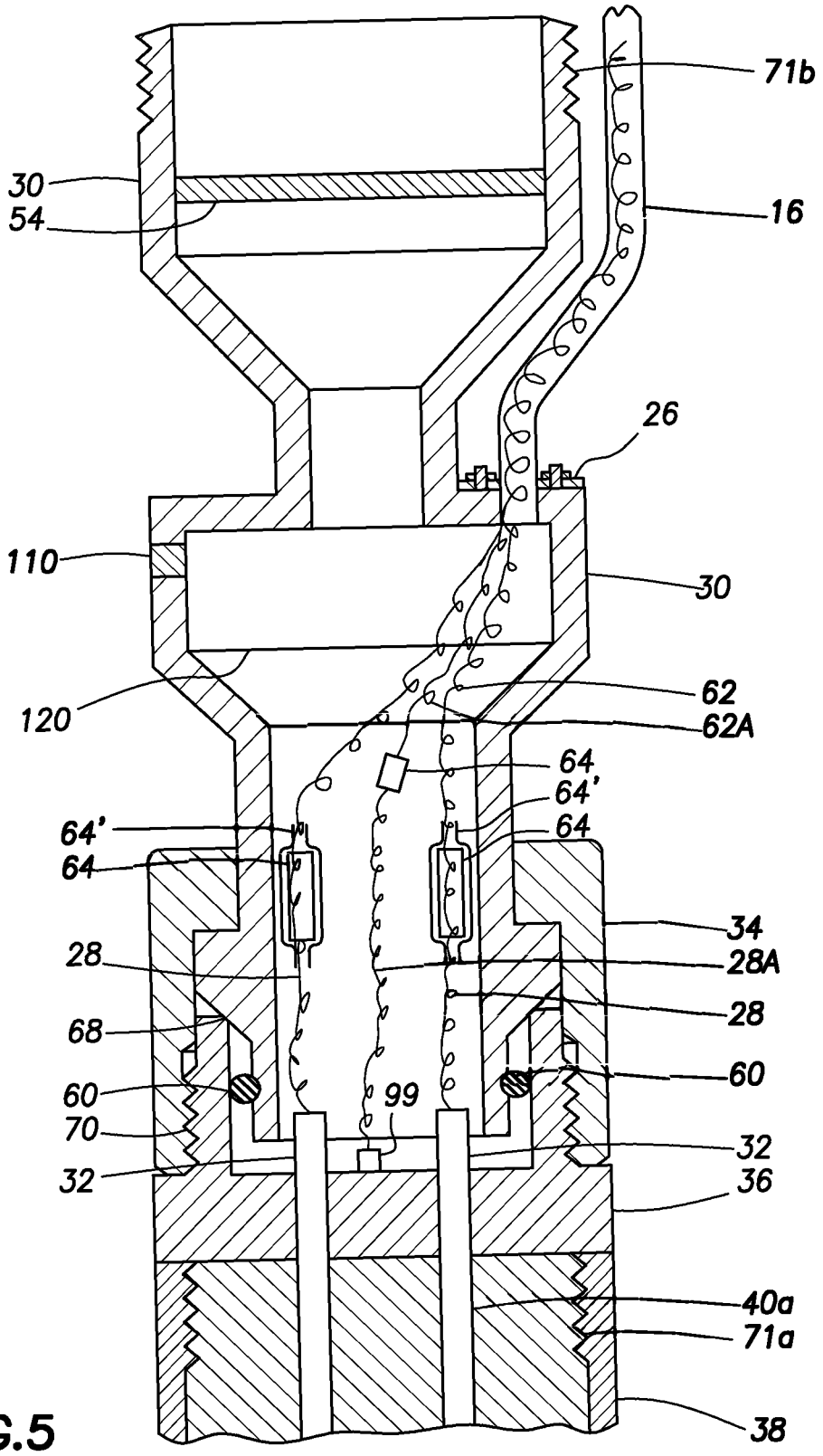
FIG. 5 depicts a partial cross section view of a downhole heating apparatus consistent with at least one embodiment of the present disclosure.

In some embodiments, with reference to FIG. 5, electrical power may be supplied to electric heating elements 40*a* from power cable 16. In some embodiments, electric heating elements 40*a* may be powered by alternating current or direct current. In some embodiments, for example and without limitation, 240 volt single phase, 240 volt three phase, 480 volt single phase, 480 volt three phase, or 110 volt single phase alternating current may be supplied to electric heating elements 40*a*. In some embodiments, voltage controller 80 may control the voltage supplied to electric heating elements 40*a* to, for example and without limitation, modulate the temperature of downhole heater 40.

Figure 5A:
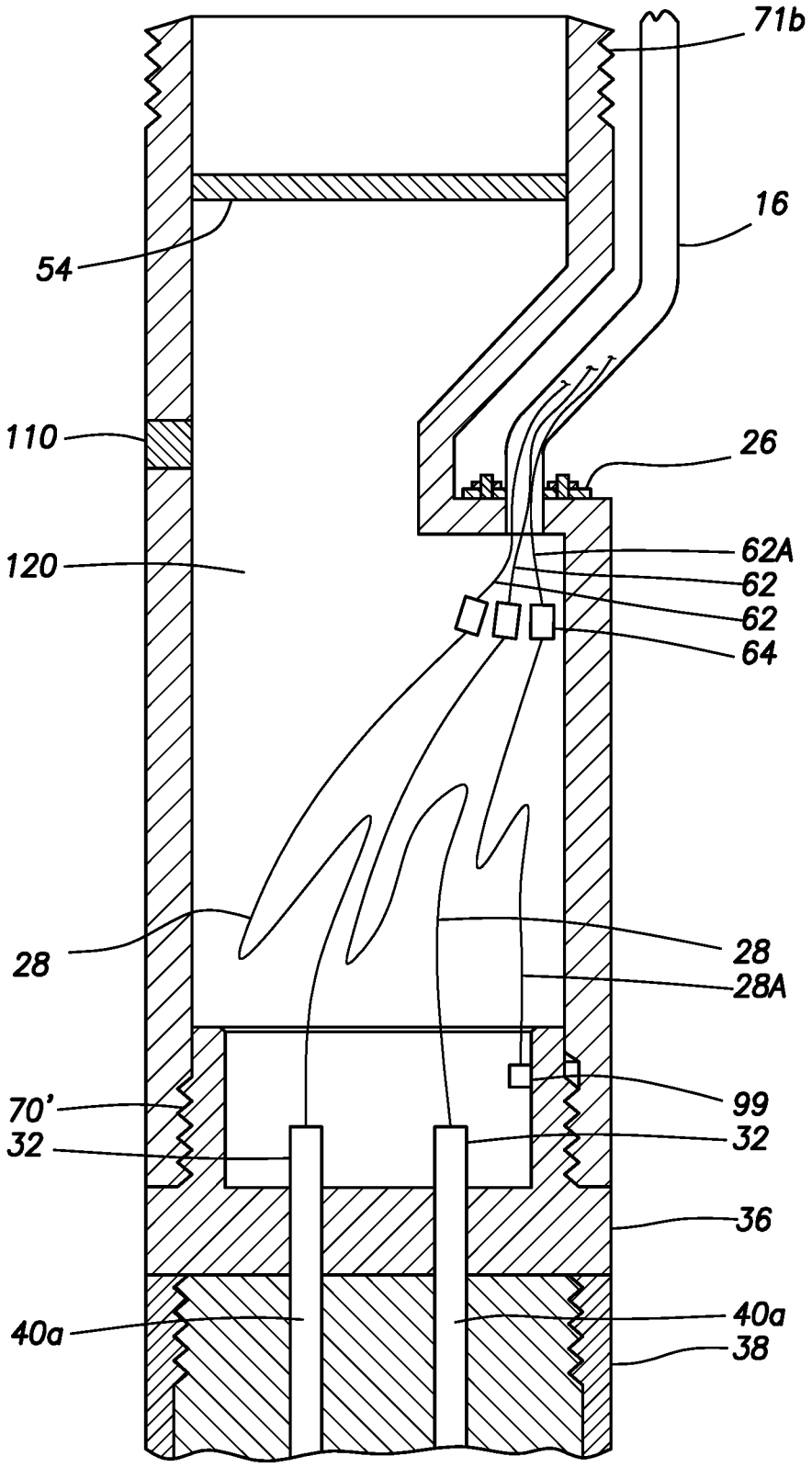
FIG. 5A depicts a partial cross section view of a downhole heating apparatus consistent with at least one embodiment of the present disclosure.

In some embodiments, power cable 16 may include one or more electrical wires 62. In some embodiments, power cable 16 may include ground wire 62A. In some embodiments, electrical connections between power cable 16 and electric heating elements 40*a* may be positioned within pothead 30. In some embodiments, pothead 30 may be a tubular member. In some embodiments, pothead 30 may define an interior enclosure which may be substantially fluidly sealed from fluids within lower annulus 1*b*. In some embodiments, pothead 30 may be at least partially filled with an insulating fluid such as transformer oil 120. In some embodiments, pothead 30 may include fill up port 110 to allow pothead 30 to be filled with transformer oil 120 after pothead 30 is assembled. In certain embodiments, pothead 30 may be mechanically coupled to downhole heater 40. In some embodiments, pothead 30 may be mechanically coupled to downhole heater 40 by integral union 34. Integral union 34 may be an annular member which may mechanically couple pothead 30 to downhole heater 40 by threaded connection 70. In some embodiments, integral union 34 may include one or more seals, such as O-ring 60 and shoulder seals 68 to fluidly seal the interior of pothead 30 from lower annulus 1*b*. For example and without limitation, integral union 34 may be a Bowen type integral union. In other embodiments, pothead 30" may be directly coupled to downhole heater 40 as depicted in FIG. 5A without the use of an integral union. In such an embodiment, threaded connection 70' may be formed between pothead 30" and downhole heater 40. Pothead 30 may include blanking plate 54 to, for example and without limitation, limit fluid ingress from above pothead 30. In some embodiments, pothead 30 may include upper threaded connection 71*b* to couple pothead 30 to lower perforated tubing joint 18 or an extension tubing joint below lower perforated tubing joint 18 as discussed further herein below.

In some embodiments, pothead 30 may include cable coupler 26. Cable coupler 26 may allow power cable 16, electrical wires 62, or ground wire 62A therefrom to enter pothead 30 while maintaining a fluid seal. In some embodiments, cable coupler 26 may mechanically couple power cable 16 to pothead 30. In some embodiments, cable coupler 26 may include one or more electrical connectors to allow power cable 16 to be electrically coupled to electrical wires 62 within pothead 30. In certain embodiments, cable coupler 26 may include one or more of quick connects, slide on connections, or snap connections. In some embodiments, cable coupler 26 may be offset or centered depending on the configuration of pothead 30.

In some embodiments, downhole heater 40 may include heater terminal block 36, which may mechanically couple to terminals 32 of electric heating elements 40*a*. In some embodiments, heater casing 38 may be mechanically coupled to heater terminal block 36 by threaded connection 71*a*. Terminals 32 may include heater wires 28. In some embodiments, electrical wires 62 may be electrically coupled to heater wires 28 such as by a crimped connection. In some embodiments, copper sleeve 64 may be positioned about electrical wires 62 and heater wires 28 and crimped to form the electrical connection. In some embodiments, downhole heater 40 may include ground nut 99 in electrical contact with a portion of downhole heater 40. In some embodiments, ground wire 28A may couple between ground nut 99 and ground wire 62A. In some embodiments, ground wires 28A and 62A may be electrically coupled by a crimped connection including a copper sleeve 64. In some embodiments, insulation 64' may be positioned about copper sleeve 64. In some embodiments, insulation 64' may include, for example and without limitation, high temperature tape or shrink wrap used to wrap one or more of heater wires 28, electrical wires 62, and copper sleeves 64 to provide electrical insulation or protection from corrosion within pothead 30. In some embodiments, pothead 30 may be at least partially filled with an insulating material such as an epoxy resin. In some such embodiments, electrical wires 62 may couple to heater wires 28 by, for example and without limitation, a press fit connection as pothead 30 is mechanically coupled to terminal block 36. In such an embodiment, the press fit connection may, for example and without limitation, include one or more of a quick connect, slide on connection, or snap connection.

In some embodiments, with reference to FIG. 2, downhole heating apparatus may include gas separator 14. Gas separator 14 may include lower perforated tubing joint 18. Lower perforated tubing joint 18 may be mechanically coupled to mandrel 20, or may be formed as a part of mandrel 20. Lower perforated tubing joint 18 may form an outer housing of gas separator 14. Lower perforated tubing joint 18 may be sealed at the bottom. In some embodiments, lower perforated tubing joint 18 may be sealed at the bottom by blanking plate 54.

In certain embodiments, lower perforated tubing joint 18 may extend through thermal barrier 12 and be fluidly sealed thereto. Lower perforated tubing joint 18 may include lower vents 90 positioned below thermal barrier 12 and in fluid communication with lower annulus 1*b*. In some embodiments, lower perforated tubing joint 18 may be mechanically coupled to upper perforated tubing joint 10. Upper perforated tubing joint 10 may be mechanically and sealingly coupled to tubing string 6 by tubing collar 8. Upper perforated tubing joint 10 may include upper vents 76 positioned above thermal barrier 12 and in fluid communication with upper annulus 1*a*. In some embodiments, lower vents 90 and upper vents 76 may be in fluid communication with the interior of lower perforated tubing joint 18. Upper vents 76 and lower vents 90 may be formed, for example and without limitation, as one or more of holes, slots, or perforations.

In some embodiments, vent 74 may be formed through thermal barrier 12. In some embodiments, vent 74 may be a hollow channel or may include a tubular segment. In some embodiments, vent 74 may be a packer bypass as understood in the art. In some embodiments, vent 74 may be part of the channel formed in thermal barrier 12 for power cable 16 as previously described. In some embodiments, such as embodiments depicted in FIG. 4, upper perforated tubing joint 10 may be eliminated, and lower perforated tubing joint 18' may include only vents 90'.

In some embodiments, vent 74 may be formed as a part of mandrel 20, pothead 30, or any other component of downhole heating apparatus 100 colocated with thermal barrier 12. For example and without limitation, as depicted in FIG. 7, vent 74 may be formed as a channel through pothead 30'. However, vent 74 may be formed in any component of downhole heating apparatus 100 without deviating from the scope of this disclosure. In some such embodiments, vent 74 may be formed in pothead 30' or other component of downhole heating apparatus 100 by, for example and without limitation, machining, forging, molding, casting, bolting, or swedging in place.

Figure 8:
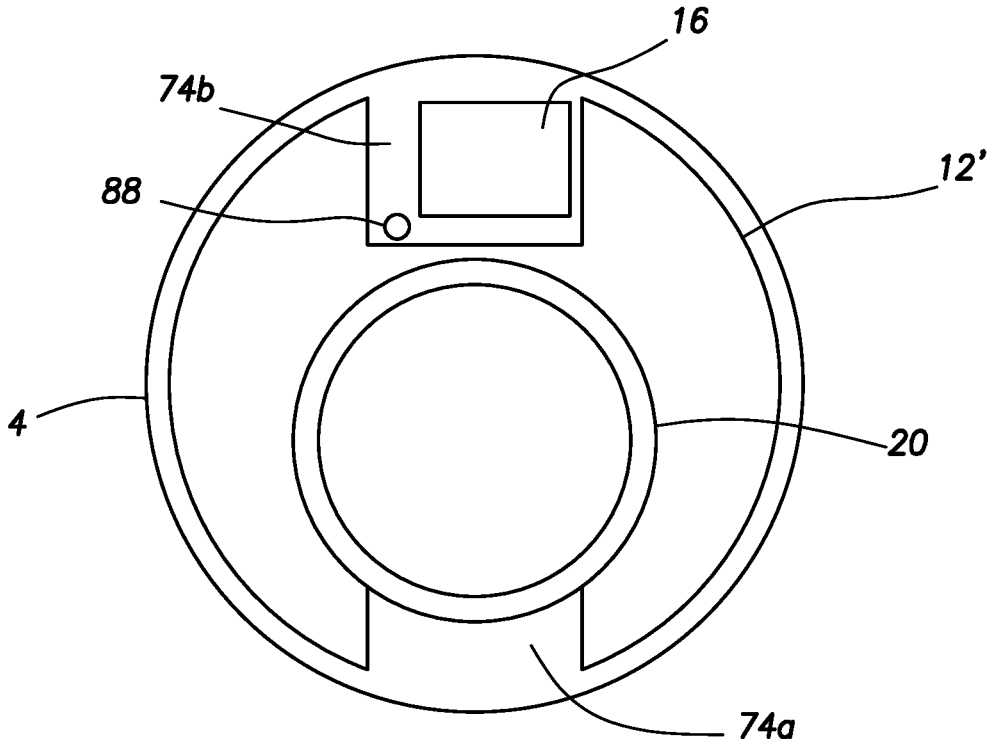
FIG. 8 depicts a cross section of a thermal barrier consistent with at least one embodiment of the present disclosure.
Figure 9:
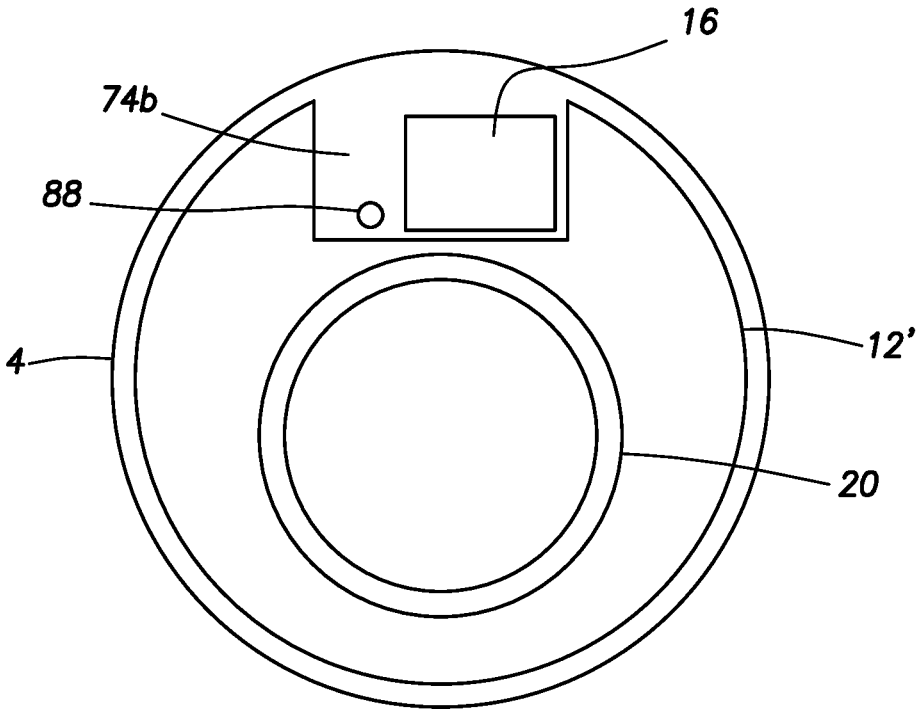
FIG. 9 depicts a cross section of a thermal barrier consistent with at least one embodiment of the present disclosure.

In some embodiments, such as those depicted in FIG. 8, vent 74*a* may be formed as a slot in thermal barrier 12'. In certain embodiments, as depicted in FIGS. 8 and 9, channel 74*b* through which power cable 16 and thermocouple cable 88 pass through thermal barrier 12' may be formed such that channel 74*b* acts as a vent allowing fluid and heat to flow through thermal barrier 12. As further depicted in FIGS. 8 and 9, thermal barrier 12' may be formed about mandrel 20 such that mandrel 20 is radially offset within casing 4. In some such embodiments, by radially offsetting mandrel 20, channel 74*b* may be larger than an embodiment in which mandrel 20 is centered within casing 4.

With respect to FIG. 2, in some embodiments, gas separator 14 may include dip tube 52. Dip tube 52 may extend partially downward through lower perforated tubing joint 18. Dip tube 52 may be mechanically coupled to mandrel 20 by seating nipple 2. Seating nipple 2 may form a fluid seal between dip tube 52 and mandrel 20. In certain embodiments, dip tube 52 may be mechanically coupled to the bottom of fluid lift device 50 or the inside of tubing string 6. Dip tube 52 may be open at dip tube upper end 52*a* and dip tube lower end 52*b*. Dip tube 52 may fluidly couple between the interior of lower perforated tubing joint 18 at dip tube lower end 52*b* and the interior of tubing string 6 at dip tube upper end 52*a*.

In some embodiments, dip tube lower end 52*b* may be positioned below lower vents 90. In some embodiments, dip tube lower end 52*b* may include screen filter 24. Screen filter 24 may, for example and without limitation, allow only fluids to enter dip tube 52, retarding the entry of solids.

Screen filter 24 may include, for example and without limitation, one or more slots, holes, or trays in dip tube lower end 52*b*. In some embodiments, dip tube 52 may include check valve 22. Check valve 22 may, for example and without limitation, prevent fluid from passing from tubing string 6 into lower perforated tubing joint 18 and lower annulus 1*b*. For example and without limitation, if fluid lift device 50 is turned off or loses prime, fluid within tubing string 6 may be prevented from flowing through gas separator 14. Although check valve 22 is depicted as a ball-and-seat check valve, any suitable type of check valve may be utilized without deviating from the scope of this disclosure.

Figure 3:
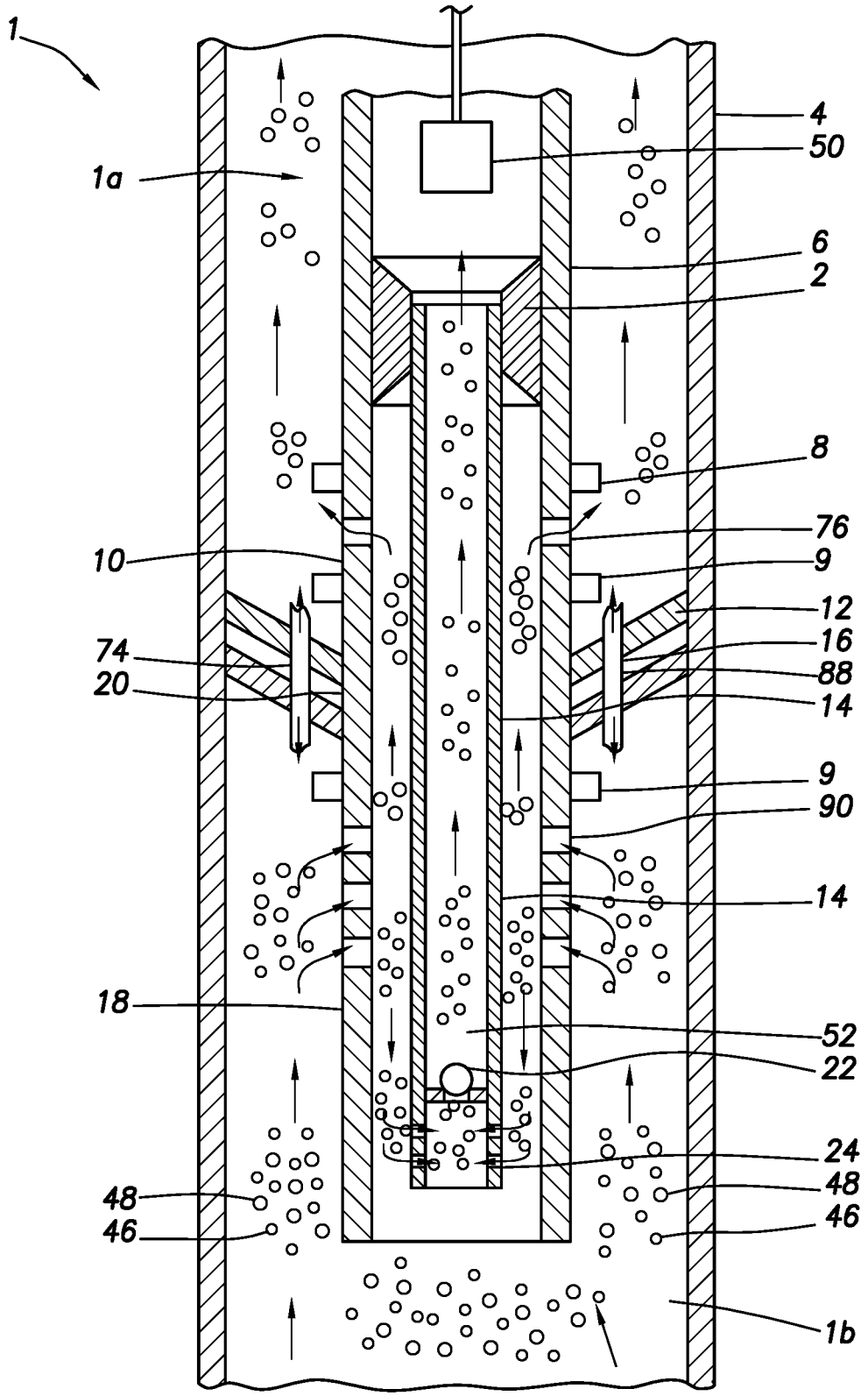
FIG. 3 depicts a partial cross section view of a downhole heating apparatus consistent with at least one embodiment of the present disclosure.

In some embodiments, as depicted in detail in FIG. 3, fluid from lower annulus 1*b* may include liquid 46 and gas 48 as previously described. For the purposes of FIG. 3, liquid 46 is depicted as solid dots, and gas 48 is depicted as open dots. As fluid within lower annulus 1*b* is heated by downhole heater 40, the fluid's viscosity may be reduced. In response to fluid pressure within downhole formation 66 or the action of fluid lift device 50, liquid 46 and gas 48 enter lower perforated tubing joint 18 through lower vents 90. In some embodiments, some of gas 48 may be entrained within liquid 46. As liquid 46 is heated by downhole heater 40, some or all of gas 48 may be freed from liquid 46.

Within lower perforated tubing joint 18, the fluid may separate by the action of gravity. In some embodiments, the less-dense gas 48 may rise within lower perforated tubing joint 18 while the more-dense liquid 46 sinks. Separated gas 48 may rise within lower perforated tubing joint 18 into upper perforated tubing joint 10 and exit through upper vent 76 into upper annulus 1*a*. Gas 48 may continue to rise in upper annulus 1*a* of casing 4, and be recovered or discarded at the surface.

Figure 4:
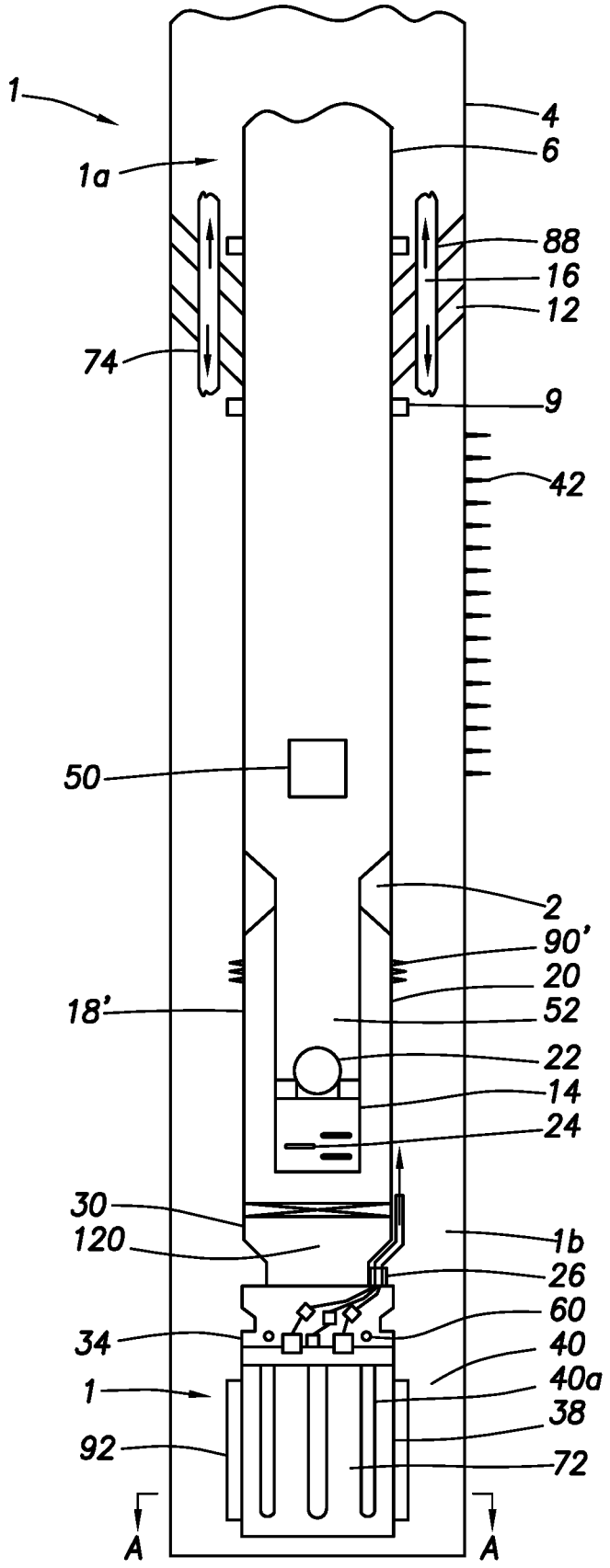
FIG. 4 depicts a cross section view of a downhole heating apparatus consistent with at least one embodiment of the present disclosure.

In other embodiments, as depicted in FIG. 4, separated gas 48 may be retained within lower perforated tubing joint 18' by seating nipple 2; separated gas 48 may exit lower perforated tubing joint 18' through vents 90' and pass through vent 74 formed in thermal barrier 12. Separated liquid 46 may sink within lower perforated tubing joint 18 until it is below dip tube 52. Liquid 46 may pass through screen filter 24 and check valve 22 and pass upward through dip tube 52 into tubing string 6. Once in tubing string 6, formation pressure or the action of fluid lift device 50 may transfer liquid 46 to the surface for production.

In some embodiments, vacuum pressure may be applied to wellbore 1 to, for example and without limitation, increase production rates. In some such embodiments, vacuum may be exerted on downhole formation 66 through lower annulus 1*b*, lower vents 90, upper vents 76, and upper annulus 1*a*. In some embodiments, vacuum may be exerted on downhole formation 66 through vent 74.

In some embodiments, one or more fluids may be introduced into lower annulus 1*b* and downhole formation 66. The fluids may travel from upper annulus 1*a*, through upper vents 76, lower vents 90, and into lower annulus 1*b*. For example and without limitation, fluids may include water, hot water, oil, hot oil, steam, or other chemicals including corrosion and scale prevention chemicals or solvents. In some embodiments, a capillary line may extend from upper vent 76 or vent 74 to the surface for circulation or placement of fluids. In some embodiments, the introduced fluids may, for example and without limitation, force any fluid within upper annulus 1*a* or lower annulus 1*b* heated by downhole heater 40 into downhole formation 66.

In some embodiments, upper annulus 1*a* may fill with fluids such as liquid 46 during, for example and without limitation, a time cycled production in which fluid lift device 50 is deactivated for a period of time. In some such embodiments, liquid 46 in upper annulus 1*a* may, for example and without limitation, flow through upper vents 76 or vent 74 into lower annulus 1*b* or into tubing string 6.

Although depicted as a single thermal barrier 12, multiple thermal barriers 12 may be included in downhole heating apparatus 100 without deviating from the scope of this disclosure. For example, one or more additional thermal barriers 12 may be positioned elsewhere on downhole heating apparatus 100 such as on downhole heater 40 to, for example and without limitation, isolate a section of casing 4.

In some embodiments, as depicted in FIG. 2, downhole heater 40, pothead 30, lower perforated tubing joint 18, gas separator 14, dip tube 52, seating nipple 2, and entry to fluid lift device 50 may be positioned at or near casing perforations 42. In some embodiments, as depicted in FIG. 4, downhole heater 40, pothead 30, lower perforated tubing joint 18, gas separator 14, dip tube 52, seating nipple 2, and entry to fluid lift device 50 may be positioned lower than casing perforations 42. In some such embodiments, for example and without limitation, fluid lift device 50 may more efficiently lift fluids from wellbore 1 in, for example and without limitation, low pressure wellbores 1.

In some embodiments, mandrel 20, tubing collar 8, gas separator 14, lower perforated tubing joint 18, pothead 30, and upper perforated tubing joint 10 may be formed from chrome moly tubing or other heat resistant material.

The foregoing outlines features of several embodiments. Such features may be replaced by any one of numerous equivalent alternatives, only some of which are disclosed herein.

The invention claimed is:

1. A downhole heating apparatus comprising:

a mandrel;

a thermal barrier, the thermal barrier positioned on an exterior surface of the mandrel, the thermal barrier including one or more thermal barrier subcomponents; and a downhole heater, the downhole heater mechanically coupled to the mandrel, the downhole heater positioned below the thermal barrier, the downhole heater including an electric heating element;

a lower perforated tubing joint, the lower perforated tubing joint being a lower vent, the lower vent positioned below the thermal barrier and fluidly coupling with a fluid coupling the interior of the lower perforated tubing joint to the exterior of the lower perforated tubing joint;

an upper perforated tubing joint, the upper perforated tubing joint being an upper vent, the upper vent positioned above the thermal barrier and fluidly coupling with the fluid coupling the interior of the upper perforated tubing joint to the exterior of the upper perforated tubing joint;

a check valve to prevent the fluid from passing into the lower perforated tubing joint; wherein the fluid is heavy oil and is low pressure;

wherein the downhole heater is in close proximity to a fluid lift device.

2. The downhole heating apparatus of claim 1, wherein the electric heating element is a resistance or inductive heating element.

3. The downhole heating apparatus of claim 1, further comprising a thermocouple cable.

4. The downhole heating apparatus of claim 1, further comprising a power cable, the power cable including one or more electrical wires electrically coupled to one or more heater wires of the electric heating element positioned within a pothead.

5. The downhole heating apparatus of claim 4, wherein the power cable passes through the thermal barrier.

6. The downhole heating apparatus of claim 4, wherein the pothead is generally tubular, the pothead mechanically coupled to the downhole heater, the power cable sealingly coupled to the pothead by a cable coupler, the wires of the power cable electrically coupled to the heater wires.

7. The downhole heating apparatus of claim 6, wherein the cable coupler includes one or more of a quick connect, slide on connection, or snap connections.

8. The downhole heating apparatus of claim 6, wherein the pothead is mechanically coupled to the mandrel.

9. The downhole heating apparatus of claim 6, wherein the downhole heater further comprises a heater block, and the pothead is mechanically connected to the heater block by a threaded connection.

10. The downhole heating apparatus of claim 9, wherein the pothead further comprises an integral union, the integral union threadedly coupled to the heater block.

11. The downhole heating apparatus of claim 10, further comprising one or more seals.

12. The downhole heating apparatus of claim 6, wherein the pothead further comprises a blanking plate, the blanking plate fluidly sealing an upper end of the pothead.

13. The downhole heating apparatus of claim 4, wherein the electrical wires are electrically coupled to the heater wires by a crimped connection.

14. The downhole heating apparatus of claim 13, further comprising one or more of tape or shrink wrap wrapped about the crimped connection.

15. The downhole heating apparatus of claim 1, wherein the downhole heater further comprises a heater casing positioned about the electric heating element.

16. The downhole heating apparatus of claim 15, wherein the heater casing includes one or more holes, slots, or perforations.

17. The downhole heating apparatus of claim 15, wherein the heater casing forms a fluid enclosure about the electric heating element.

18. The downhole heating apparatus of claim 17, wherein the heater casing is at least partially filled with a heat transfer fluid.

19. The downhole heating apparatus of claim 15, wherein the heater casing further comprises one or more fins positioned on an exterior surface of the heater casing.

20. The downhole heating apparatus of claim 1, further comprising a gas separator, the gas separator mechanically coupled to the mandrel, the gas separator positioned above the downhole heater.

21. The downhole heating apparatus of claim 20, wherein the gas separator further comprises a dip tube, the dip tube extending downward within the lower perforated tubing joint, the dip tube being open at an upper end and a lower end of the dip tube, the dip tube mechanically coupled to the mandrel and fluidly sealed to the mandrel.

22. The downhole heating apparatus of claim 21, wherein the dip tube is mechanically coupled to the mandrel and fluidly sealed to the mandrel by a seating nipple.

23. The downhole heating apparatus of claim 21, wherein the dip tube further comprises a screen filter.

24. The downhole heating apparatus of claim 1, wherein the thermal barrier includes one or more thermal flow paths.

25. The downhole heating apparatus of claim 1, wherein the thermal barrier includes one or more vents.

26. A downhole apparatus comprising: a mandrel;

a thermal barrier, the thermal barrier positioned on an exterior surface of the mandrel, the thermal barrier including one or more thermal barrier subcomponents; and a gas separator, the gas separator mechanically coupled to the mandrel;

a lower perforated tubing joint, the lower perforated tubing joint being a lower vent, the lower vent positioned below the thermal barrier and fluidly coupling with a fluid coupling the interior of the lower perforated tubing joint to the exterior of the lower perforated tubing joint;

an upper perforated tubing joint, the upper perforated tubing joint being an upper vent, the upper vent positioned above the thermal barrier and fluidly coupling the fluid coupling the interior of the upper perforated tubing joint to the exterior of the upper perforated tubing joint;

a check valve to prevent fluid from passing into the lower perforated tubing joint, wherein the fluid is a heavy oil and is low pressure;

wherein the downhole heater is in close proximity to a fluid lift device.

27. The downhole apparatus of claim 26, wherein the thermal barrier includes one or more thermal flow paths.

28. The downhole apparatus of claim 26, wherein the gas separator further comprises a dip tube, the dip tube extending downward within the lower perforated tubing joint, the dip tube being open at an upper end and a lower end of the dip tube, the dip tube mechanically coupled to the mandrel and fluidly sealed to the mandrel.

29. The downhole apparatus of claim 28, wherein the dip tube is mechanically coupled to the mandrel and fluidly sealed to the mandrel by a seating nipple.

30. The downhole apparatus of claim 28, wherein the dip tube further comprises a screen filter.

31. The downhole apparatus of claim 26, further comprising a downhole heater, the downhole heater mechanically coupled to the mandrel, the downhole heater positioned below the gas separator, the downhole heater including an electric heating element.

32. The downhole apparatus of claim 31, wherein the electric heating element is a resistance or inductive heating element.

33. The downhole apparatus of claim 31, further comprising a thermocouple cable.

34. The downhole apparatus of claim 31, further comprising a power cable, the power cable including one or more electrical wires electrically coupled to one or more heater wires of the electric heating element positioned within a pothead.

35. The downhole apparatus of claim 34, wherein the power cable passes through the thermal barrier.

36. The downhole apparatus of claim 34, wherein the pothead is generally tubular, the pothead mechanically coupled to the downhole heater, the power cable sealingly coupled to the pothead by a cable coupler, the electrical wires of the power cable electrically coupled to the heater wires.

37. The downhole apparatus of claim 36, wherein the cable coupler includes one or more of a quick connect, slide on connection, or snap connections.

38. The downhole apparatus of claim 36, wherein the pothead is mechanically coupled to the mandrel.

39. The downhole apparatus of claim 38, wherein the pothead further comprises an integral union, the integral union threadedly coupled to the heater block.

40. The downhole apparatus of claim 36, wherein the downhole heater further comprises a heater block, and the pothead is mechanically connected to the heater block by a threaded connection.

41. The downhole apparatus of claim 40, further comprising one or more seals.

42. The downhole apparatus of claim 36, wherein the electrical wires are electrically coupled to the heater wires by a crimped connection.

43. The downhole apparatus of claim 36, wherein the pothead further comprises a blanking plate, the blanking plate fluidly sealing an upper end of the pothead.

44. The downhole apparatus of claim 31, wherein the downhole heater further comprises a heater casing positioned about the electric heating element.

45. The downhole apparatus of claim 44, wherein the heater casing includes one or more holes, slots, or perforations.

46. The downhole apparatus of claim 44, wherein the heater casing forms a fluid enclosure about the electric heating element.

47. The downhole apparatus of claim 46, wherein the heater casing is at least partially filled with a heat transfer fluid.

48. The downhole apparatus of claim 44, wherein the heater casing further comprises one or more fins positioned on an exterior surface of the heater casing.

49. A system comprising:

a wellbore formed in a downhole formation, the wellbore including a casing, the casing including one or more perforations;

a downhole heating apparatus, the downhole heating apparatus positioned within the wellbore, the downhole apparatus mechanically coupled to a tubing string, the downhole heating apparatus including:

a mandrel;

a thermal barrier, the thermal barrier positioned on an exterior surface of the mandrel, the thermal barrier including one or more thermal barrier subcomponents, the thermal barrier extending from the exterior surface of the mandrel, the thermal barrier positioned above the perforations in the casing, the thermal barrier defining an upper annulus and a lower annulus, the upper annulus defined as the interior of the casing above the thermal barrier and the lower annulus defined as the interior of the casing below the thermal barrier; and a gas separator, the gas separator mechanically coupled to the mandrel;

a lower perforated tubing joint, the lower perforated tubing joint being a lower vent, the lower vent positioned below the thermal barrier and fluidly coupling with a fluid coupling the interior of the lower perforated tubing joint to the exterior of the lower perforated tubing joint;

an upper perforated tubing joint, the upper perforated tubing joint being an upper vent, the upper vent positioned above the thermal barrier and fluidly coupled with the fluid coupling the interior of the upper perforated tubing joint to the exterior of the upper perforated tubing joint;

a check valve to prevent fluid from passing into the lower perforated tubing joint; wherein the fluid is a heavy oil and is low pressure;

wherein the downhole heater is in close proximity to a fluid lift device.

50. The system of claim 49, further comprising the fluid lift device positioned at least partially in the tubing string.

51. The system of claim 49, wherein the gas separator further comprises a dip tube, the dip tube extending downward within the lower perforated tubing joint, the dip tube being open at an upper end and a lower end of the dip tube, the dip tube mechanically coupled to the mandrel and fluidly sealed to the mandrel, the dip tube fluidly coupled to an interior of the tubing string.

52. The system of claim 51, wherein the dip tube is mechanically coupled to the mandrel and fluidly sealed to the mandrel by a seating nipple.

53. The system of claim 51, wherein the dip tube further comprises a screen filter.

54. The system of claim 49, further comprising a heating apparatus, the heating apparatus mechanically coupled to the mandrel, the heating apparatus positioned below the gas separator, the heating apparatus including an electric heating element.

55. The system of claim 54, wherein the electric heating element is a resistance or inductive heating element.

56. The system of claim 54, further comprising a thermocouple cable.

57. The system of claim 54, further comprising a power cable, the power cable including one or more electrical wires electrically coupled to one or more heater wires of the electric heating element positioned within a pothead.

58. The system of claim 57, wherein the pothead is generally tubular, the pothead mechanically coupled to the downhole heater, the power cable sealingly coupled to the pothead by a cable coupler, the electrical wires of the power cable electrically coupled to the heater wires.

59. The system of claim 58, wherein the cable coupler includes one or more of a quick connect, slide on connection, or snap connections.

60. The system of claim 58, wherein the pothead is mechanically coupled to the mandrel.

61. The system of claim 58, wherein the downhole heater further comprises a heater block, and the pothead is mechanically connected to the heater block by a threaded connection.

62. The system of claim 61, wherein the pothead further comprises an integral union, the integral union threadedly coupled to the heater block.

63. The system of claim 62, further comprising one or more seals.

64. The system of claim 58, wherein the electrical wires are electrically coupled to the heater wires by a crimped connection.

65. The system of claim 58, wherein the pothead further comprises a blanking plate, the blanking plate fluidly sealing an upper end of the pothead.

66. The system of claim 57, wherein the power cable passes through the thermal barrier.

67. The system of claim 54, wherein the downhole heater further comprises a heater casing positioned about the electric heating element.

68. The system of claim 67, wherein the heater casing includes one or more holes, slots, or perforations.

69. The system of claim 67, wherein the heater casing forms a fluid enclosure about the electric heating element.

70. The system of claim 69, wherein the heater casing is at least partially filled with a heat transfer fluid.

71. The system of claim 67, wherein the heater casing further comprises one or more fins positioned on an exterior surface of the heater casing.

* * * * *